US009662887B2

(12) United States Patent
Saito et al.

(10) Patent No.: US 9,662,887 B2
(45) Date of Patent: May 30, 2017

(54) PRINTING DEVICE

(71) Applicant: CANON KABUSHIKI KAISHA, Tokyo (JP)

(72) Inventors: Hiroyuki Saito, Machida (JP); Hiroyuki Saito, Yokohama (JP); Yuji Kanome, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/822,043

(22) Filed: Aug. 10, 2015

(65) Prior Publication Data

US 2016/0052279 A1 Feb. 25, 2016

(30) Foreign Application Priority Data

Aug. 22, 2014 (JP) ..... 2014-169765

(51) Int. Cl.
*B41J 2/165* (2006.01)

(52) U.S. Cl.
CPC ..... *B41J 2/16538* (2013.01); *B41J 2/16541* (2013.01); *B41J 2/16552* (2013.01); *B41J 2002/16558* (2013.01)

(58) Field of Classification Search
CPC B41J 2/16535; B41J 2/16538; B41J 2/16541; B41J 2/16544; B41J 2/16547; B41J 2002/1655; B41J 2002/16558; B41J 2/1754; B41J 2002/16514
See application file for complete search history.

(56) References Cited

U.S. PATENT DOCUMENTS

| | | | |
|---|---|---|---|
| 5,245,362 | A | 9/1993 | Iwata et al. |
| 6,062,670 | A | 5/2000 | Iwata et al. |
| 6,109,725 | A | 8/2000 | Saikawa et al. |
| 6,565,188 | B1 | 5/2003 | Saito |
| 7,556,342 | B2 | 7/2009 | Hamano |

FOREIGN PATENT DOCUMENTS

| | | | |
|---|---|---|---|
| JP | 2007-69579 | A | 3/2007 |

*Primary Examiner* — Kristal Feggins
(74) *Attorney, Agent, or Firm* — Fitzpatrick, Cella, Harper & Scinto

(57) ABSTRACT

A printing device able to suppress the leakage of head fluid is provided. The printing device includes: a print head having an ejection opening face on which are formed ejection openings that eject ink; a wiper that wipes the ejection opening face; a holding member that holds head fluid; a transfer member that transfers the head fluid held in the holding member to the wiper; and a switching unit configured to switch between a communicating state in which the holding member and the transfer member communicate, and a non-communicating state in which the holding member and the transfer member do not communicate.

8 Claims, 12 Drawing Sheets

PRINTING DEVICE

BACKGROUND OF THE INVENTION

Field of the Invention

The present invention relates to a printing device that wipes an ejection opening face of a print head using a wiper.

Description of the Related Art

There is known a method of using a wiper applied with head fluid (hereinafter simply called "fluid") to wipe an ejection opening face on which the ejection openings of a print head are formed. Japanese Patent Laid-Open No. 2007-69579 discloses a configuration in which, in the orientation while a printing device is used, the contact position between a transfer member and a bottom face which is the lower face in the gravitational direction of a holding member that holds the fluid, is positioned lower in the gravitational direction than the position where fluid is transferred from the transfer member to the wiper. With this configuration, the bottom face of the holding member and the transfer member are made to contact, and the capillary force of the transfer member causes the head fluid held in the holding member to rise up and be transferred to the wiper.

Sometimes, such as during transport, for example, the orientation of a printing device becomes different from the orientation during use. With the configuration in Japanese Patent Laid-Open No. 2007-69579, the state of contact between the holding member and the transfer member is maintained even in an orientation that differs from the orientation during use. In the case of this configuration, factors such as the change in the pressure imposed on contact portion between the holding member and the transfer member due to varying orientation causes the amount of fluid supplied from the holding member to the transfer member to change, and sometimes fluid leaks from the transfer member.

SUMMARY OF THE INVENTION

The present invention provides a printing device able to suppress the leakage of head fluid.

According to a first aspect of the present invention, there is provided a printing device including: a print head having an ejection opening face on which are formed ejection openings that eject ink; a wiper that wipes the ejection opening face; a holding member that holds head fluid; a transfer member that transfers the head fluid held in the holding member to the wiper; and a switching unit configured to switch between a communicating state in which the holding member and the transfer member communicate, and a non-communicating state in which the holding member and the transfer member do not communicate.

According to the present invention, by providing the switching unit, the state between the holding member that holds the head fluid and the transfer member that transfers the head fluid to the wiper is appropriately switched, and leakage of the head fluid may be suppressed.

Further features of the present invention will become apparent from the following description of exemplary embodiments (with reference to the attached drawings).

DESCRIPTION OF THE EMBODIMENTS

Hereinafter, embodiments of the present invention will be described in detail and with reference to the drawings.

First Embodiment

Figure 1:
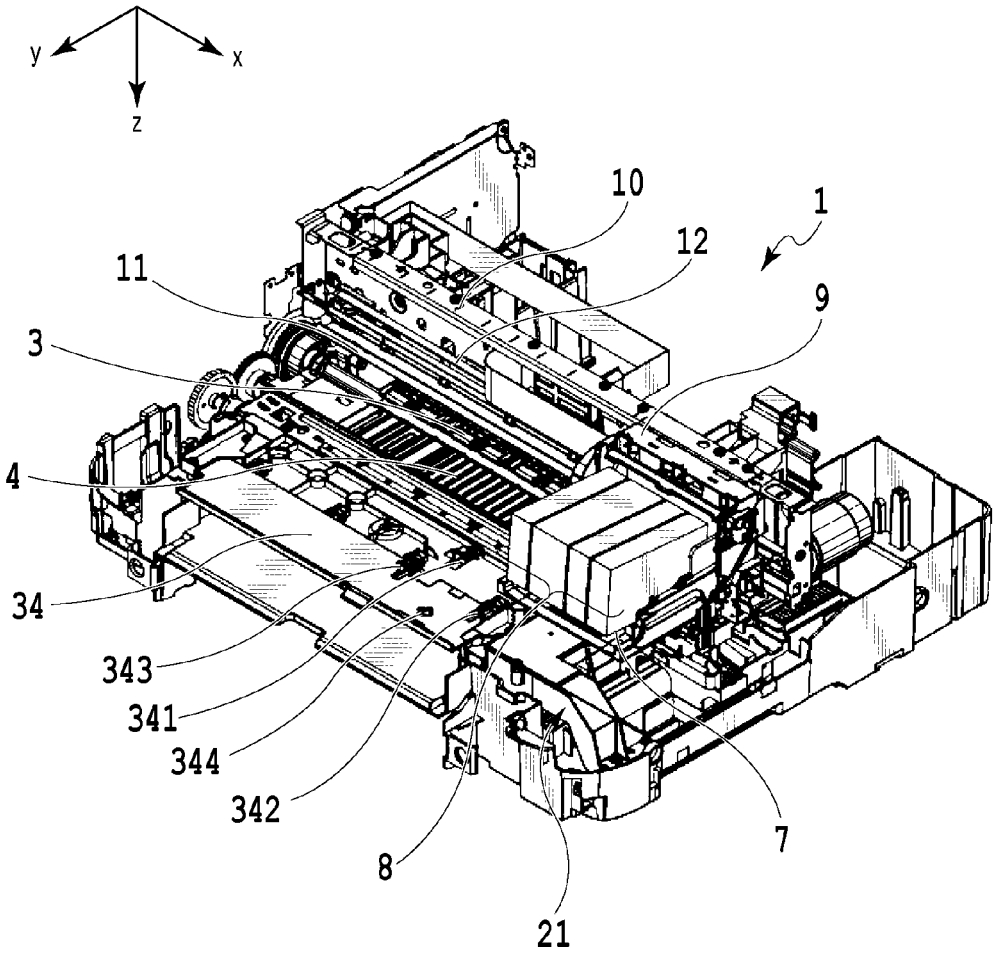
FIG. 1 is a perspective view illustrating an internal configuration of a printing device.
Figure 2:
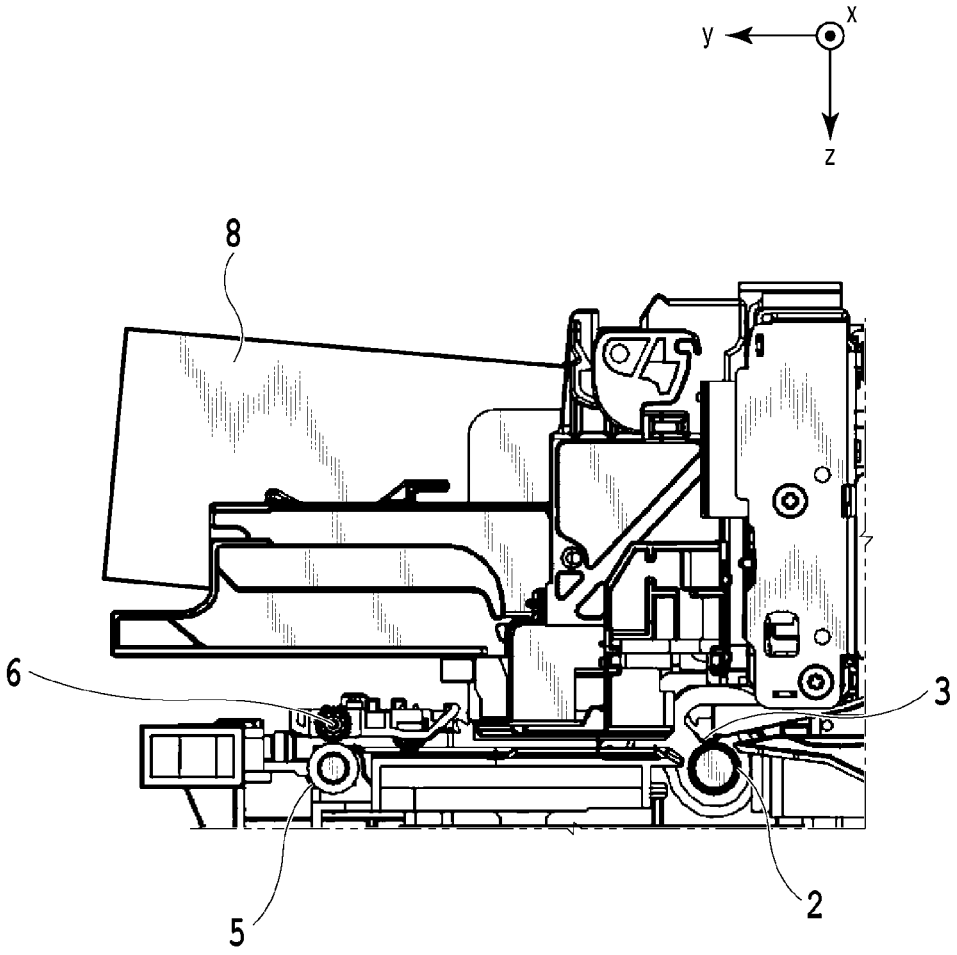
FIG. 2 is a cross-section view illustrating an internal configuration of a printing device.

FIG. 1 is a perspective view illustrating an internal configuration of an inkjet printing device (hereinafter called the "printing device") 1 according to the present embodiment. FIG. 2 is a cross-section view illustrating an internal configuration of the printing device 1. As illustrated in FIGS. 1 and 2, the printing device 1 includes a conveyance roller 2, a pinch roller 3, a platen 4, a discharge roller 5, a spur 6, a print head 7, an ink tank 8, a carriage 9, an upper guide rail 10, a lower guide rail 11, a driving belt 12, and the like. A sheet fed from an automatic sheet feeding device (not illustrated) that separates and sends stacked sheets one at a time is held between the conveyance roller 2 and the pinch roller 3, conveyed in a conveyance direction (the y direction in the drawings) by the rotation of the rollers, and supplied between the print head 7 and the platen 4. The driving force of a carriage motor (not illustrated) is transmitted to the carriage 9 via the driving belt 12, thereby causing the carriage 9 to move back and forth in the x direction along the upper guide rail 10 and the lower guide rail 11. The print head (inkjet print head) 7 is mounted on the carriage 9. As the carriage 9 moves, ink is ejected according to a print signal from ejection openings provided on the face of the print head 7 that faces opposite the sheet (the ejection opening face), thereby causing an image or the like to be printed onto the sheet. After printing, the sheet is held between the discharge roller 5 and the spur 6, and delivered outside the printing device 1.

In the printing device 1, the position of the carriage 9 illustrated in FIG. 1 is the home position of the carriage 9, and the carriage 9 is controlled to be positioned at the home position after printing ends and the like. At the home position a recovery operation for recovering the ejection function of the ejection openings on the print head 7 is executed on the print head 7.

On a discharge top cover 34, there are provided a first locking part 341, a second locking part 342, a third locking part 343, and a fourth locking part 344. When the printing device 1 is being transported, the locking parts of a carriage stopper (removable securing member) 33 to be discussed later with reference to FIG. 8 interlock with the above locking parts to secure the carriage 9 with respect to the printing device 1.

Figure 3:
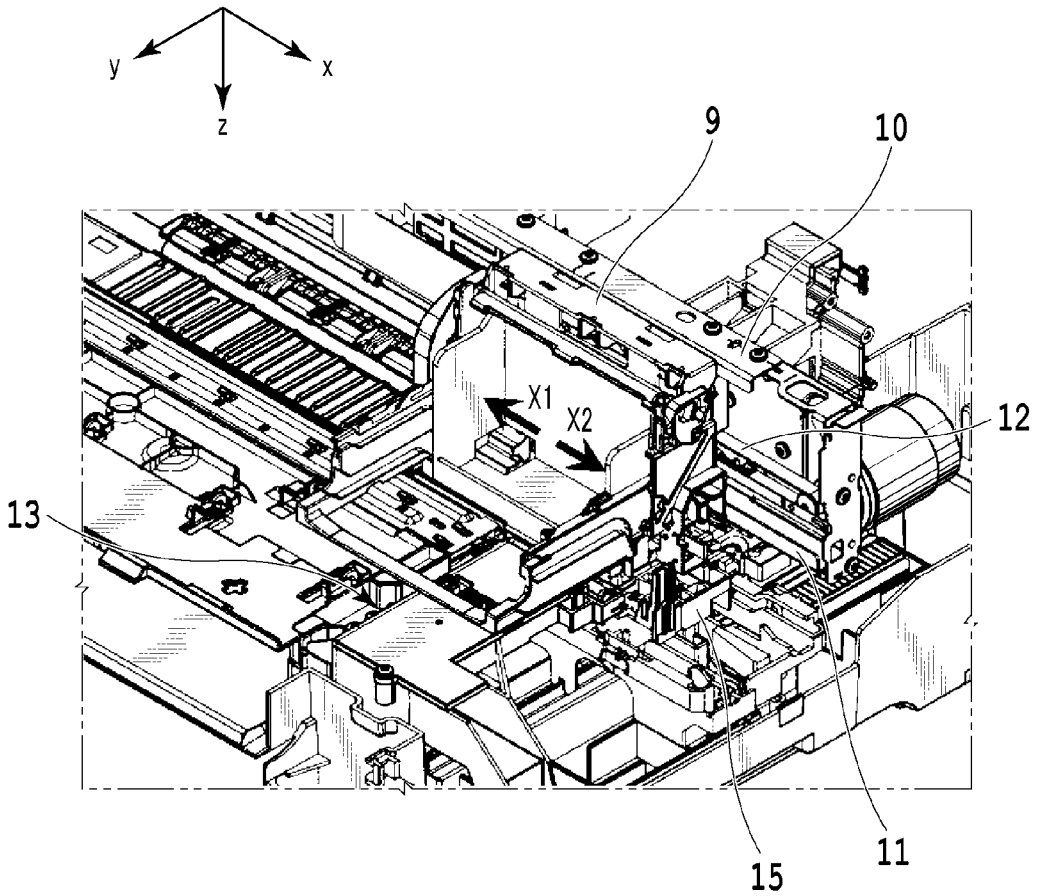
FIG. 3 is a perspective view illustrating a carriage when an ink tank and the like are not mounted.
Figure 4:
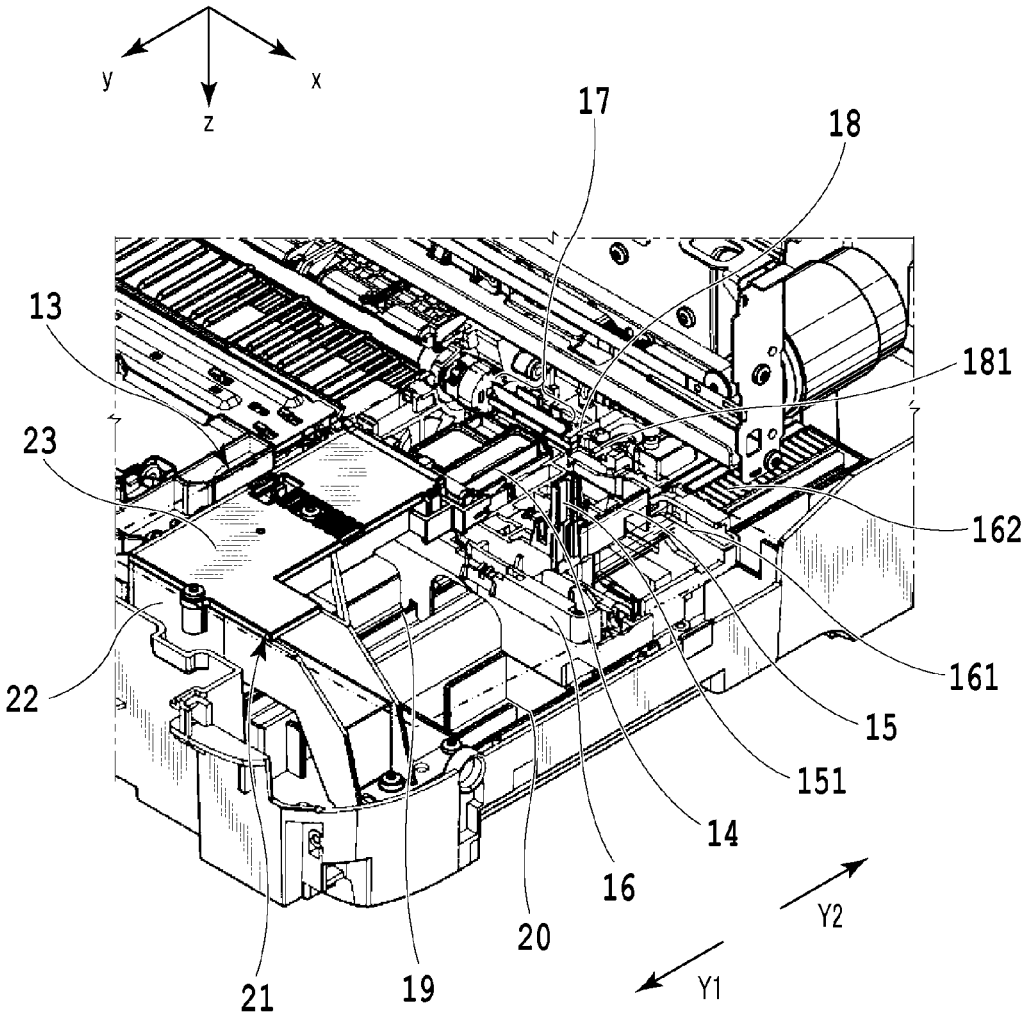
FIG. 4 is a perspective view illustrating a configuration of an ejection recovery device.

FIG. 3 is a perspective view illustrating an internal configuration of the printing device 1 when the print head 7 and the ink tank 8 are not mounted on the carriage 9. As illustrated in FIG. 3, an ejection recovery device 13 is disposed at a lower position in the gravitational direction (the z direction in the drawings) than the position of the carriage 9. Although later discussed in detail with reference to FIG. 4, the ejection recovery device 13 includes a wiping mechanism and a capping mechanism, and performs an operation for recovering the ejection performance of the print head 7. FIG. 4 is a perspective view illustrating the configuration of the ejection recovery device 13, and is a perspective view illustrating a state in which the carriage 9 has moved in the X1 direction illustrated in FIG. 3. As illustrated in FIG. 4, the ejection recovery device 13 includes a cap 14, a cap slider 15, a slider base 16, a wiper blade 17, a blade holder 18, a rail 19, a rail 20, a fluid reservoir tank 21, and the like.

The cap 14 covers and seals the ejection openings of the print head 7, preventing issues such as drying of the ink in the ejection openings when not printing and the adherence of dirt to the ejection openings. The cap 14 is supported on the cap slider 15, and the cap slider 15 is slidably supported on the guide part 161 of the slider base 16. The cap slider 15 is biased in the X1 direction illustrated in FIG. 3 by a cap slider spring (not illustrated), and stops at the position illustrated in FIG. 3 while an image is being printed. When the carriage 9 moves in the X2 direction and abuts a carriage abutting part 151 of the cap slider 15, the ejection openings of the print head 7 are disposed at a position facing opposite the cap 14. When the carriage 9 moves in the X2 direction while in a state of abutting the carriage abutting part 151, the cap slider 15 is guided by the guide part 161 of the slider base 16 to rise in the z direction. The cap 14 supported on the cap slider 15 rises in the z direction while maintaining the positional relationship facing opposite the ejection openings of the print head 7, abuts the print head 7, and seals the ejection openings. In this state, a pump (not illustrated) connected to the cap is operated to reduce pressure inside the cap, and a suction recovery operation of drawing surrounding ink into the cap and discharging the ink is conducted. Since ink and the like still adheres to the ejection opening face even after the suction recovery operation, the ejection opening face is wiped by the wiper blade 17 in order to remove the remaining ink and the like.

The wiper blade 17 is held by the blade holder 18, and is secured to the slider base 16 via the blade holder 18. As illustrated in FIG. 4, three wiper blades are used herein, but the number of wiper blades is not limited to three. A rack 162 is secured to the slider base 16, and if a gear (not illustrated) that engages with the rack 162 is made to rotate due to the rotation of a driving motor (not illustrated), the slider base 16 is guided by the rail 19 and the rail 20, and moves in the Y1 direction or the Y2 direction. Note that operation and the like of each member in the printing device, such as the movement of the carriage and the movement of the slider base, is controlled by a controller not illustrated in the drawings.

Head fluid is stored in the fluid reservoir tank 21. The head fluid includes water, glycerin, and alcohol. The head fluid includes functions such as a function of dissolving ink thickeners and film-forming agents accumulated on the ejection opening face, a function of reducing wear on the wiper blades and the like by increasing lubrication between the wiper blade 17 and the ejection opening face, and a function of protecting the ejection opening face by forming a film on the ejection opening face. In addition, the head fluid increases lubrication between the wiper blade 17 and the ejection opening face of the print head 7 when wiping the ejection opening face, thereby preventing unwiped ink, dirt, and the like caused by stick-slip, and minimizing fluctuations in operating torque when wiping. As illustrated in FIG. 4, the fluid reservoir tank 21 according to the present embodiment has a box-like structure including a case part 22 and a lid part 23.

Figure 5A:
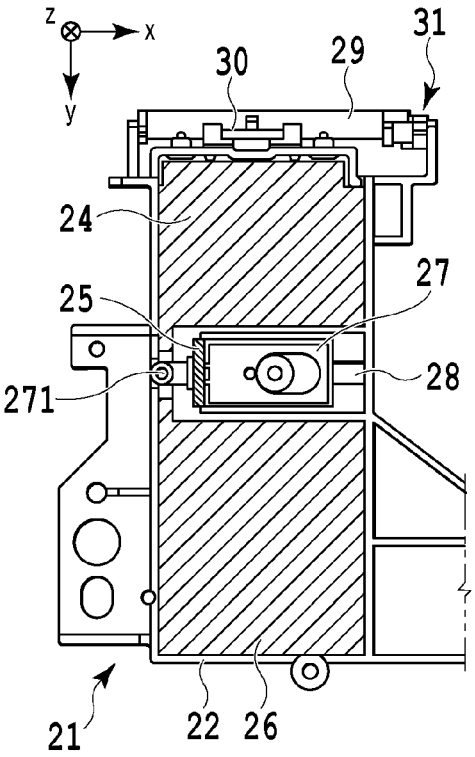
FIG. 5A is a diagram for explaining a configuration of a fluid reservoir tank.
Figure 5B:
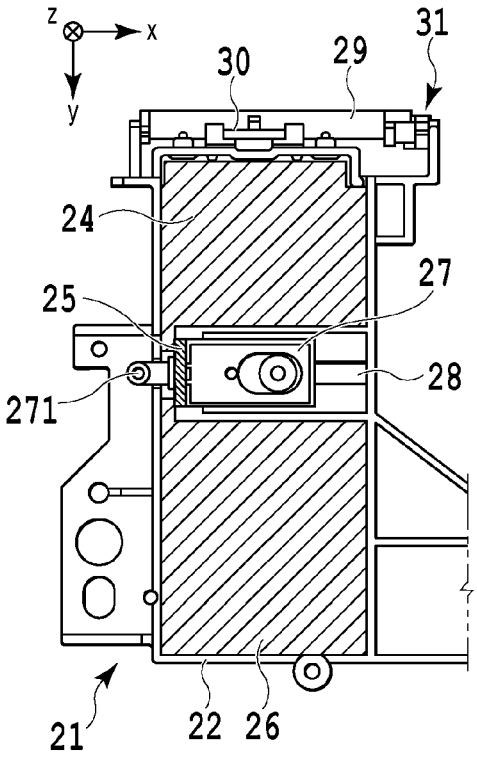
FIG. 5B is a diagram for explaining a configuration of a fluid reservoir tank.
Figure 5C:
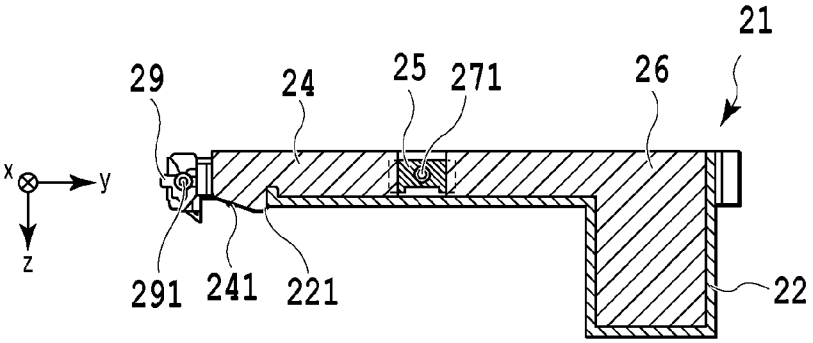
FIG. 5C is a diagram for explaining a configuration of a fluid reservoir tank.

FIGS. 5A to 5C are diagrams for explaining a configuration of the fluid reservoir tank 21. FIGS. 5A and 5B are plan views depicting the fluid reservoir tank 21 from above in the gravitational direction, in which FIG. 5A illustrates a state in which fluid inside the fluid reservoir tank 21 is not in a communicating state, while FIG. 5B illustrates a communicating state. FIG. 5C is a cross-section view depicting the fluid reservoir tank 21 from the left side of the printing device 1, provided that the view from the downstream side in the y direction illustrated in FIG. 1 is the front view. In the following, the right side and the left side respectively indicate the right side and the left side with respect to the front of the printing device 1, which is taken to be the view from the downstream side in the direction illustrated in FIG. 1. Note that FIGS. 5A to 5C illustrate a state in which the lid part 23 illustrated in FIG. 4 has been removed.

As illustrated in FIGS. 5A to 5C, the case part 22 houses a first holding member (transfer member) 24, a second holding member (connecting member) 25, and a third holding member (holding member) 26. More specifically, the second holding member 25 is disposed at an abuttable position with the first holding member 24, and the third holding member 26 is disposed at an abuttable position with the second holding member 25. The first holding member 24, the second holding member 25, and the third holding member 26 are made of a porous material. Also, in the present embodiment, the first holding member 24, the second holding member 25, and the third holding member 26 are impregnated with head fluid.

As illustrated in FIG. 5C, an opening 221 is provided on the case part 22, and an exposed part 241 of the first holding member 24 is exposed from the opening 221. Herein, the opening 221 is provided at a position on the upstream side in the y direction and on the lower side in the z direction. The fluid stored inside the fluid reservoir tank 21 is transferred to the wiper blade 17 as a result of the exposed part 241 and the wiper blade 17 abutting each other.

As illustrated in FIGS. 5A and 5B, the second holding member 25 is secured to a movably configured slide lever (moving member) 27. A slide lever spring (biasing member) 28 is attached to the slide lever 27. Also, a projecting part 271 that projects diagonally from the right side towards the left side is provided on the slide lever 27.

Although later discussed in detail with reference to FIG. 9, in the present embodiment, during transport or the like of the printing device 1, the projecting part 271 is depressed by a slide lever pressing part 333 to be discussed later with reference to FIG. 9, resulting in the state illustrated in FIG. 5A. As a result of the projecting part 271 being pressed from the opposite direction of the bias direction by a stronger force than the biasing force imparted by the slide lever spring 28, the slide lever 27 is disposed at a position on the right side of the printing device 1. Consequently, as illustrated in FIG. 5A, the configuration enters a separated state in which the second holding member 25 secured to the slide lever 27 does not abut the first holding member 24 and the third holding member 26.

When the depressed state of the projecting part 271 by the slide lever pressing part 333 is released, the force of the slide lever spring 28 causes the slide lever 27 to slide to the left side of the printing device 1, and the second holding member 25 is biased towards the first holding member 24 and the third holding member 26. As a result, the configuration enters the state illustrated in FIG. 5B, which is a state in which the holding members abut each other.

Herein, the communicating state refers to a state in which fluid held in the holding members communicates among the holding members, whereas the non-communicating state refers to a state in which fluid held in the holding members does not communicate among the holding members. Additionally, herein, the fluid enters the communicating state as a result of the holding members abutting each other, and enters the non-communicating state as a result of the holding members becoming separated from each other.

In the present embodiment, the slide lever 27 with the second holding member 25 secured thereto is made to slide, thereby putting the holding members in an abutting state or a separated state, and switching between the communicating state and the non-communicating state of the fluid.

The capillary force of the holding members will now be described. In order to transfer and supply fluid held in the holding members to the wiper blade 17 abutting the exposed part 241 of the first holding member 24, the capillary force of the exposed part 241 and the surrounding area is set higher than the capillary force of other parts. In other words, the magnitude relationship of the capillary force of the holding members is configured as follows.

Capillary force of first holding member 24 >capillary force of second holding member 25 >capillary force of third holding member 26.

The quantity of fluid injected into each holding member is set to an approximate quantity at which fluid does not leak from the exposed part 241 under the usage conditions anticipated for the printing device 1. Specifically, the quantity of fluid with which to impregnate each holding member is set to a quantity of fluid that may be held inside the holding member by the capillary force with respect to the maximum hydraulic head pressure anticipated by orientation changes of the printing device 1. Even if the quantity of fluid is set in this way, fluid may still leak in some cases, depending on the transport conditions or the like. To suppress such leakage in the present embodiment, during transport, the holding members are separated so that fluid does not communicate among the holding members, thereby suppressing fluid leakage from the fluid reservoir tank 21.

Herein, the holding members are kept in the separated state during transport and the like before the printing device 1 starts being used, but if the quantity of fluid to inject into the first holding member 24 is set to a comparatively low quantity in order to suppress fluid leakage, the desired quantity of fluid may not be transferred to the wiper blade 17 when the printing device 1 starts being used. For this reason, the quantity of fluid to inject into the first holding member 24 is set so that the required quantity of fluid for wiping may be transferred to the wiper blade even when the holding members abut each other and fluid starts to communicate when the printing device 1 starts being used. In other words, the quantity of fluid to inject into the first holding member 24 is determined appropriately from the relationship between the capillary force and the quantity of fluid to hold, and set to a quantity enabling the desired quantity of fluid to be transferred from the exposed part 241 to the wiper blade 17 even when the holding members are in the separated state, and also a quantity at which the fluid does not leak. Consequently, the wiping function by the wiper blade 17 on the ejection opening face of the print head 7 is sufficiently exhibited from when the printing device 1 starts being used, and reductions in image quality are suppressed while fluid leakage is also suppressed. As above, the quantity of fluid to inject into each holding member and with which to impregnate each holding member is set by accounting for various parameters.

As illustrated in FIGS. 5A and 5B, on the upstream side of the fluid reservoir tank 21 in the y direction, a blade cleaner 29, a blade cleaner returning spring 30, and a blade cleaner retraction lever 31 are provided. As illustrated in FIG. 5C, the blade cleaner 29 has an axial part 291. In addition, the ends of the axial part 291 in the x direction are axially supported by a bearing not illustrated in the drawings. The blade cleaner retraction lever 31 is connected to end on the right side of the blade cleaner 29. Also, the blade cleaner returning spring 30 is disposed at a position in the approximate center of the blade cleaner 29 in the x direction and on the upper side in the z direction. These structural elements will be described with reference to FIG. 6.

Figure 6:
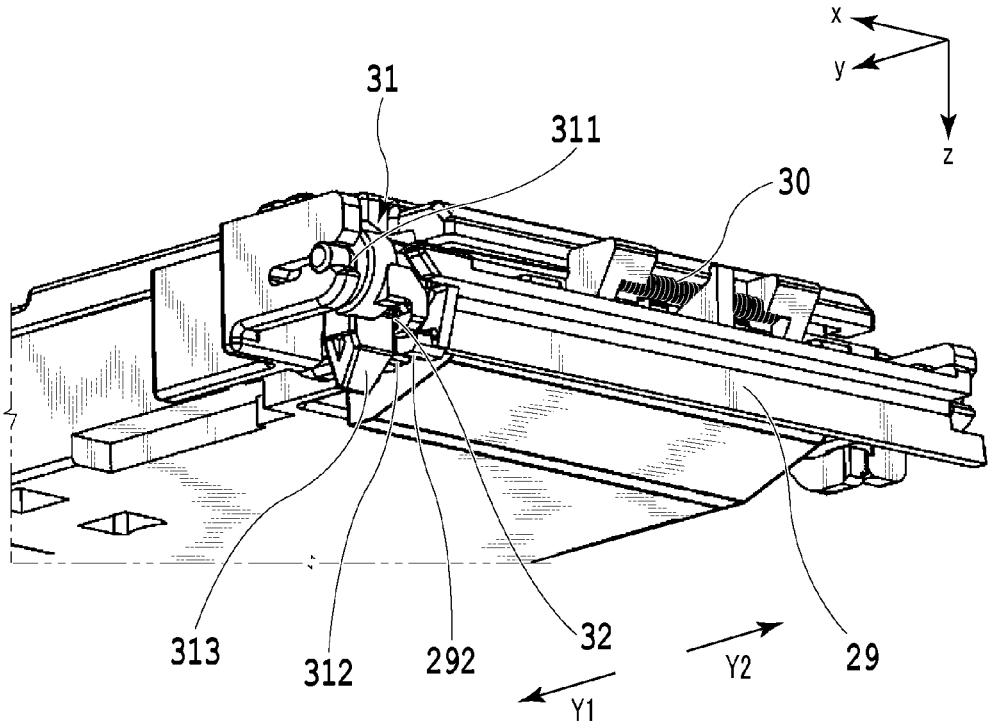
FIG. 6 is a perspective view illustrating a blade cleaner retraction lever.

FIG. 6 is a perspective view illustrating the blade cleaner retraction lever 31. As illustrated in FIG. 6, the blade cleaner retraction lever 31 includes an axial part 311, an abutting part 312, and a lever part 313. The axial part 311 is axially supported on a bearing, and the blade cleaner retraction lever 31 is rotatable about the axial part 311. The abutting part 312 is integrated with the lever part 313, and biased towards an abutted part 292 of the blade cleaner 29 by a torsion coil spring 32.

When the wiper blade 17 moves downstream in the y direction (the Y1 direction) and passes through the blade cleaner 29, the blade cleaner retracting member 181 illustrated in FIG. 4 contacts the lever part 313, and pushes the lever part 313 from down to up in the z direction. The rotation of the blade cleaner retraction lever 31 due to the lever part 313 being pressed causes the blade cleaner 29 connected to the blade cleaner retraction lever 31 to rotate. The rotation range of the blade cleaner 29 is regulated by a rotation stop not illustrated in the drawings, and the blade cleaner 29 does not rotate in a clockwise direction according to a front view of the drawings past the positions illustrated in FIGS. 7B and 7C discussed later. Note that even in the state in which the rotation of the blade cleaner 29 is regulated by the rotation stop not illustrated in the drawings, the blade cleaner retraction lever 31 is still able to rotate. Herein, the biasing force from the abutting part 312 of the blade cleaner retraction lever 31 to the abutted part 292 of the blade cleaner 29 due to the torsion coil spring 32 is configured to be smaller than the force with which the blade cleaner retracting member 181 pushes the lever part 313.

Consequently, rotation of the blade cleaner 29 exceeding a designated range is regulated by the rotation stop not illustrated in the drawings, causing the blade cleaner retraction lever 31 to rotate without accompanying rotation of the blade cleaner 29.

Likewise, when the wiper blade 17 moves upstream in the y direction (the Y2 direction) and passes through the blade cleaner 29, the blade cleaner retracting member 181 illustrated in FIG. 4 contacts the lever part 313, and pushes the lever part 313 from down to up in the z direction. As a result, the blade cleaner retraction lever 31 rotates, the abutting part 312 pushes the abutted part 292 of the blade cleaner 29, and the blade cleaner 29 rotates to a position that does not contact the wiper blade 17, moving from a contact position to a retracted position. Consequently, when moving in the Y2 direction, the wiper blade 17 moves without contacting the blade cleaner 29.

Figure 7A:
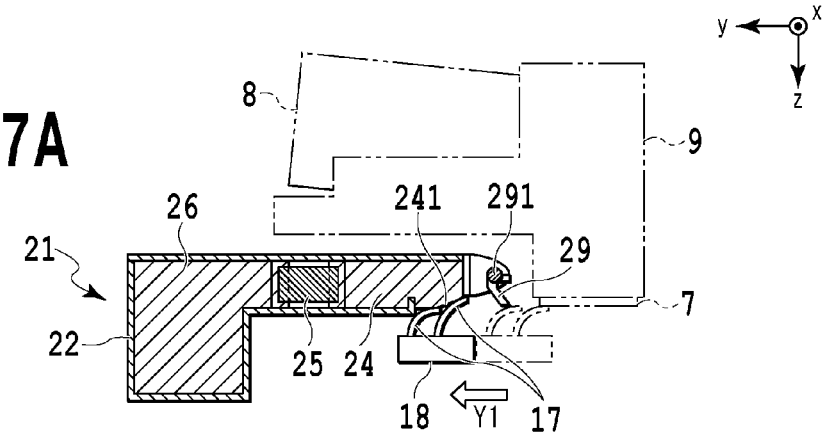
FIG. 7A is a cross-section view illustrating the placement of a blade cleaner.
Figure 7B:
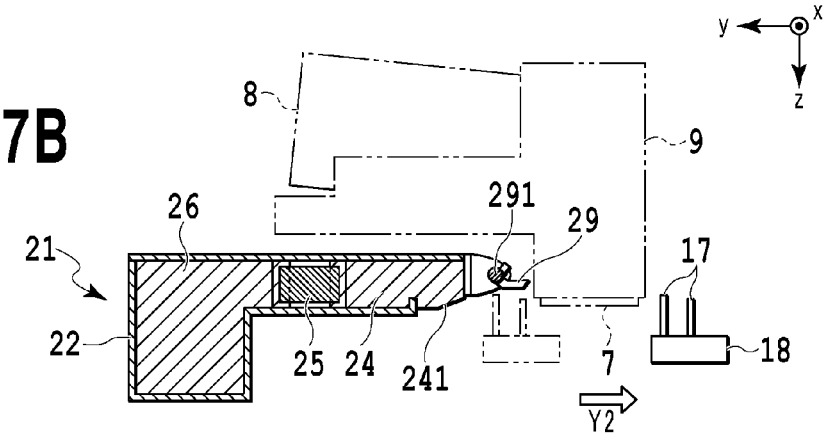
FIG. 7B is a cross-section view illustrating the placement of a blade cleaner.
Figure 7C:
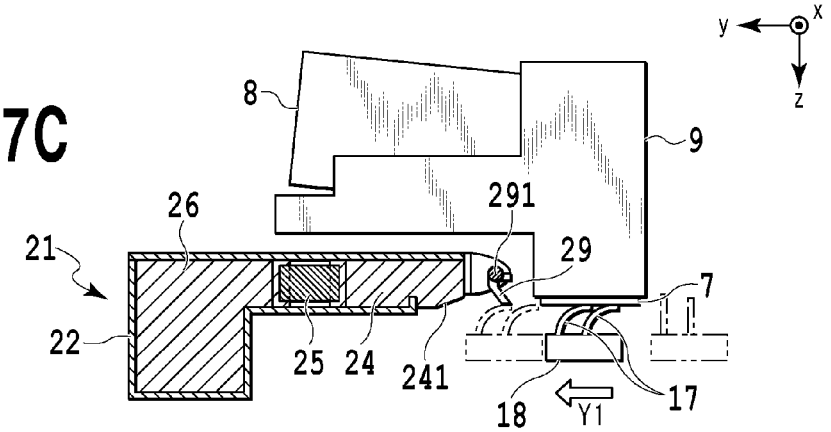
FIG. 7C is a cross-section view illustrating the placement of a blade cleaner.

The positional relationship between the wiper blade 17 and the blade cleaner 29 at each stage will be described with reference to FIGS. 7A to 7C. FIGS. 7A to 7C are cross-section views illustrating the state of the wiper blade 17 at each stage. FIG. 7A is a cross-section view illustrating the state in which fluid is applied to the wiper blade 17, while FIG. 7B is a cross-section view illustrating the state in which the wiper blade 17 moves to an initial position. FIG. 7C is a cross-section view illustrating the state in which the wiper blade 17 wipes the ejection opening face of the print head 7.

Fluid is applied to the wiper blade 17 in the state in which the print head 7 is not positioned at the home position. Subsequently, after the wiper blade 17 with fluid applied moves to an initial position, the print head 7 moves to the home position. For this reason, in FIGS. 7A and 7B, the print head 7 and the carriage 9 are indicated by broken lines.

As illustrated in FIG. 7A, when fluid is applied to the wiper blade 17, the blade cleaner 29 is disposed at a contact position enabling contact with the wiper blade 17. When the wiper blade 17 moves in the Y1 direction, the wiper blade 17 contacts the blade cleaner 29, and dirt or the like on the wiper blade 17 is removed. The wiper blade 17 passes through the position contacting the blade cleaner 29, and abuts the exposed part 241 of the first holding member 24. Consequently, the fluid impregnating the exposed part 241 is applied to the wiper blade 17. By appropriately adjusting factors such as the abutting time, an appropriate amount of fluid is applied to the wiper blade 17.

After fluid is applied to the wiper blade 17, as illustrated in FIG. 7B, the wiper blade 17 moves in the Y2 direction, and is disposed at the initial position (the position of the wiper blade 17 illustrated in FIG. 7B). While moving, the blade cleaner 29 is disposed in the retracted position illustrated in FIG. 7B in order to prevent the quantity of fluid applied to the wiper blade 17 from changing, and also to prevent ink or the like adhering to the blade cleaner 29 from re-adhering to the wiper blade 17. Specifically, as the blade holder 18 moves in the Y1 direction, the blade cleaner retracting member 181 of the blade holder 18 also moves in the Y1 direction, and the blade cleaner retracting member 181 pushes the lever part 313 of the blade cleaner retraction lever 31. Consequently, the blade cleaner 29 moves in a counter-clockwise direction according to a front view of the drawings.

After the wiper blade 17 is disposed at the initial position, the carriage 9 moves to the home position. When the carriage 9 is positioned at the home position, as illustrated in FIG. 7C, the wiper blade 17 moves in the Y1 direction while abutting the ejection opening face of the print head 7, thereby wiping the ejection opening face with the wiper blade 17. Consequently, thickened ink, dirt, and the like adhering to the ejection openings and the ejection opening face of the print head 7 are removed.

Figure 8:
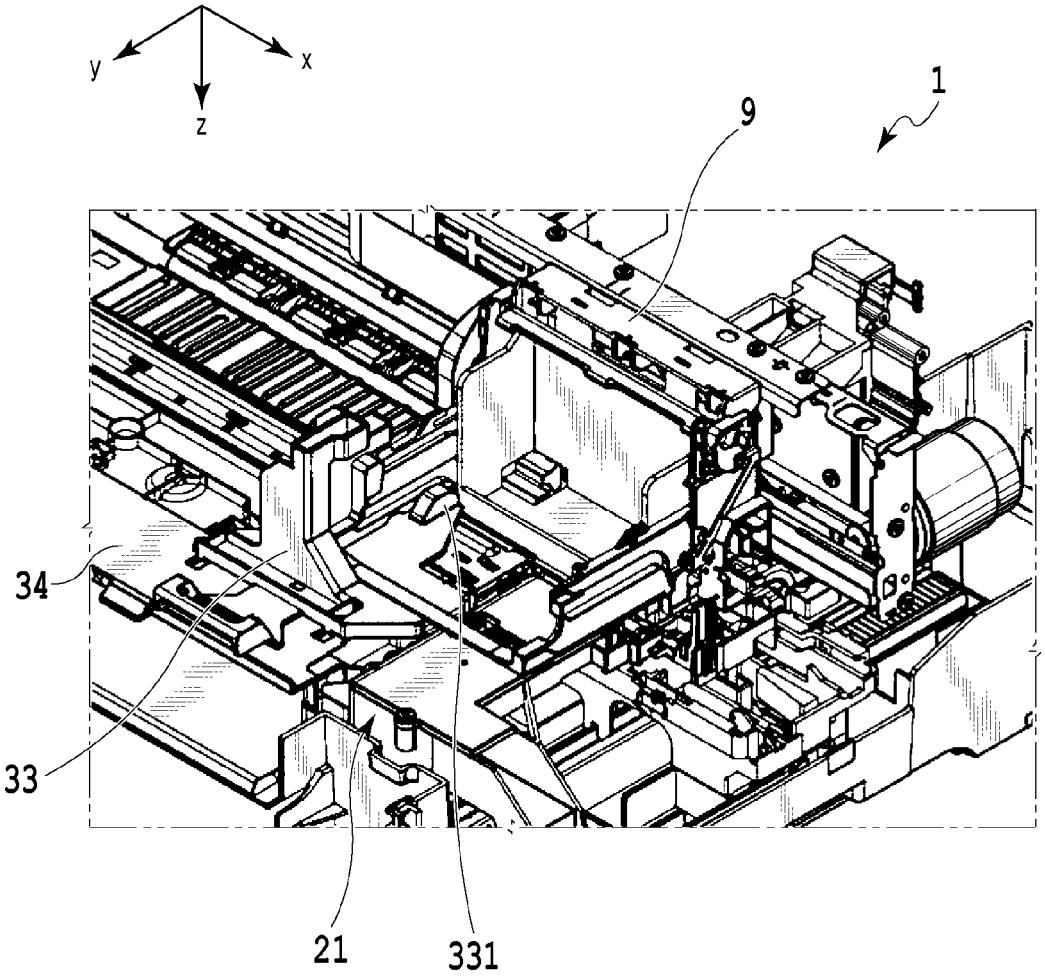
FIG. 8 is a perspective view illustrating an internal configuration of a printing device during transport.
Figure 9:
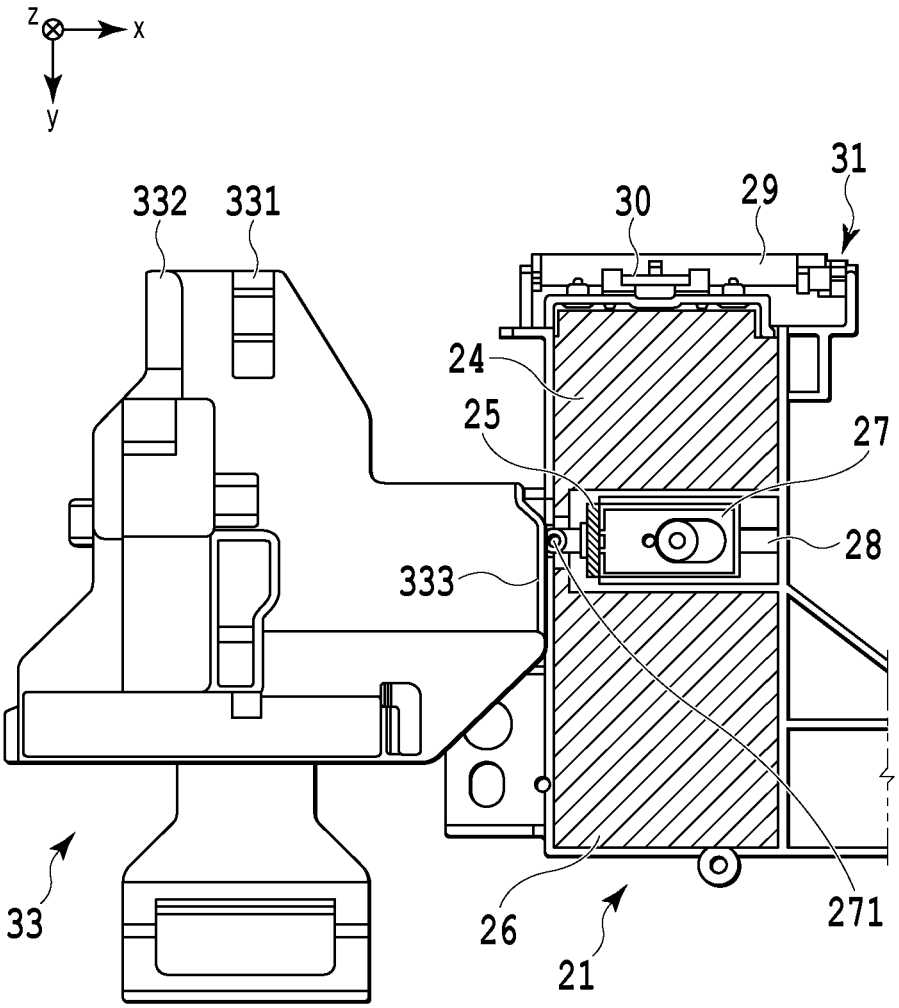
FIG. 9 is a plan view illustrating a fluid reservoir tank and a carriage stopper.

FIGS. 8 and 9 are diagrams for explaining the internal configuration of the printing device 1 during transport, in which FIG. 8 is a perspective view, and FIG. 9 is a plan view illustrating the state viewed from above in the gravitational direction. As illustrated in FIG. 8, during transport, the position of the carriage 9 is secured by a carriage stopper 33. Specifically, locking parts (not illustrated) of the carriage stopper 33 interlock with the locking parts of the discharge top cover 34 described with reference to FIG. 1, thereby securing the carriage stopper 33 to the discharge top cover 34, and restraining the carriage 9 with the carriage stopper 33. As illustrated in FIGS. 8 and 9, the carriage stopper 33 includes a first carriage restraining part 331 and a second carriage restraining part 332, which limit movement and orientation variations of the carriage 9. Restraining the carriage 9 at a designated position in a designated orientation prevents wear and the like on the members of the printing device 1 caused by movement of the carriage 9 due to vibrations and shocks during transport of the printing device 1. When the printing device 1 is used, the carriage stopper 33 is removed from the discharge top cover 34, and the restrained state of the carriage 9 is released. In this way, the carriage stopper 33 is removably attached to the device housing.

The internal state of the fluid reservoir tank 21 during transport will be described with reference to FIG. 9. FIG. 9 illustrates a state in which the lid part 23 has been removed. As illustrated in FIG. 9, the carriage stopper 33 includes a slide lever pressing part 333. Also, as illustrated in FIG. 9, in the state in which the carriage stopper 33 is restraining the carriage 9, the slide lever pressing part 333 presses the projecting part 271, and the slide lever 27 is in a state of being positioned on the right side. In this state, the second holding member 25 secured to the slide lever 27 is separated from the first holding member 24 and the third holding member 26. In this way, by separating some of the holding members from each other during transport, it is possible to suppress fluid leakage from the exposed part 241 caused by factors such as a change in the pressure imposed on the abutting parts between the holding members due to orientation variations during transport.

When the carriage stopper 33 is removed from the discharge top cover 34, the depressed state of the projecting part 271 by the slide lever pressing part 333 is released, and biasing force from the slide lever spring 28 causes the slide lever 27 to move towards the left side. When the slide lever 27 becomes positioned on the left side due to this movement, the second holding member 25 enters a state of abutting the first holding member 24 and the third holding member 26. As a result, the fluid held in each holding member enters a communicating state. When the printing device 1 is used, the fluid held in each holding member is made to communicate by causing the holding members to abut each other, and the desired quantity of fluid is intermittently supplied to the wiper.

In this way, in the present embodiment, the slide lever pressing part 333, the projecting part 271, the slide lever 27, and the slide lever spring 28 function as a switching unit that switches between a communicating state and a non-communicating state of the holding members.

The dimensions of the holding members are configured so that in the orientation of the printing device 1 in the usage state, the cross-sectional area of a slice along the horizontal direction of the entire holding member obtained by joining the holding members is greater than the cross-sectional area of a slice along the vertical direction. As a result, the hydraulic head pressure imposed on the exposed part 241 during usage of the printing device 1 is reduced comparatively, and the leakage of fluid when the holding members are in a state of contact is also suppressed.

Second Embodiment

In the present embodiment, the configuration of the mechanism for switching between the communicating state and the non-communicating state of the holding members differs from the first embodiment. Other aspects of the configuration are similar to the first embodiment, and thus their description will be reduced or omitted.

Figure 10A:
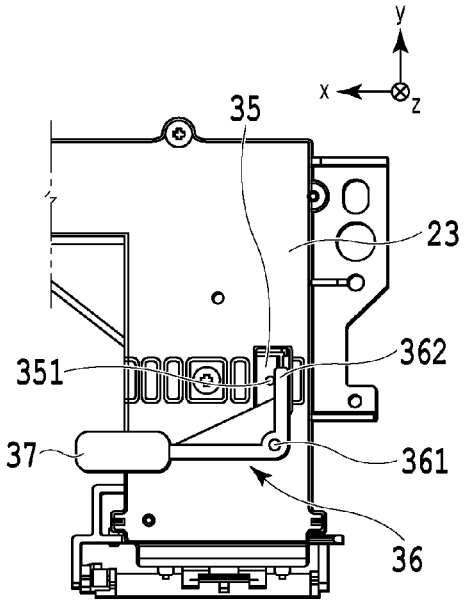
FIG. 10A is a plan view illustrating a fluid reservoir tank according to a second embodiment.
Figure 10B:
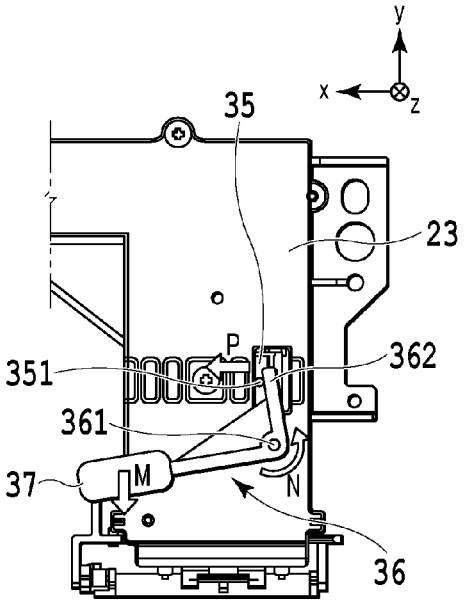
FIG. 10B is a plan view illustrating a fluid reservoir tank according to a second embodiment.
Figure 10C:
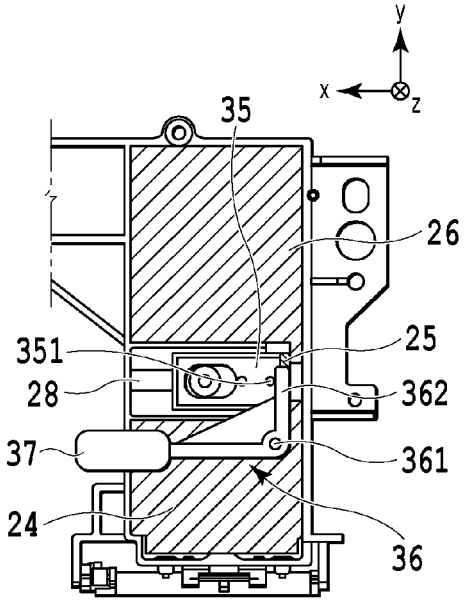
FIG. 10C is a plan view illustrating a fluid reservoir tank according to a second embodiment.
Figure 10D:
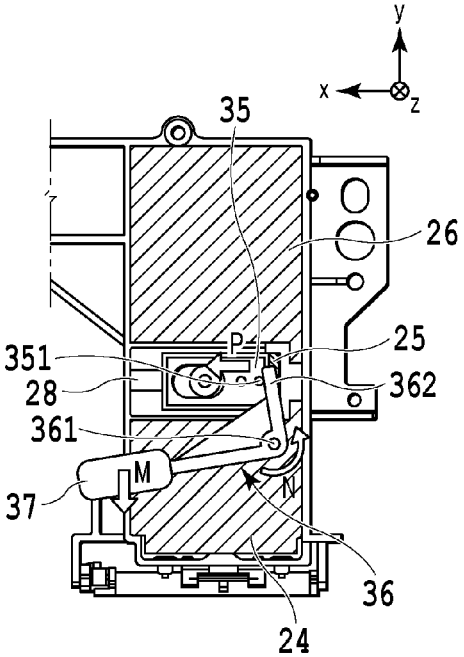
FIG. 10D is a plan view illustrating a fluid reservoir tank according to a second embodiment.

FIGS. 10A to 10D are plan views illustrating the fluid reservoir tank 21 according to the present embodiment, and are diagrams for explaining the operation of a joint switch lever 36. Note that FIG. 10C illustrates the state illustrated in FIG. 10A with the lid part 23 removed, while FIG. 10D illustrates the state illustrated in FIG. 10B with the lid part 23 removed.

As illustrated in FIGS. 10A to 10D, the joint switch lever (lever member) 36 is disposed at a higher position in the z direction than the position of the fluid reservoir tank 21. The joint switch lever 36 is supported on a support part (not illustrated) and freely able to rotate about a center of rotation 361, with a pressing part 362 provided on one end, and a weight (weight part) 37 provided on the other end. In the present embodiment, the second holding member 25 is likewise secured to a slide lever 35. Also, the slide lever 35 includes a projecting part 351 that projects upwards in the z direction. At this point, if the joint switch lever 36 rotates counter-clockwise according to a front view of the drawings, the pressing part 362 presses against the projecting part 351, causing the slide lever 35 to slide and the second holding member 25 to separate from the first holding member 24 and the third holding member 26.

FIGS. 10A and 10C illustrate the arrangement of the joint switch lever 36 during usage of the printing device 1. The slide lever spring 28 biases the slide lever 35 towards the left side of the printing device 1. During usage of the printing device 1, the force that moves the weight 37 in the direction of the arrow M illustrated in FIGS. 10B and 10D, or in other words the force that rotates the joint switch lever 36, is not produced. In the case illustrated in FIGS. 10A and 10C, the pressing part 362 is abutting the projecting part 351, but the biasing force on the slide lever 35 from the slide lever spring 28 is stronger than the pressing force on the projecting part 351 from the pressing part 362, and thus the slide lever 35 does not move. For this reason, the abutting state of the holding members is maintained, and the fluid held in the holding members is in a communicating state.

If the orientation of the printing device 1 changes during transport, and becomes an orientation in which the third holding member 26 is positioned on the upper side in the gravitational direction while the exposed part 241 of the first holding member 24 is positioned on the lower side in the gravitational direction, the weight 37 moves in the direction of the arrow M, as illustrated in FIG. 10B. As a result, a force causing rotation about the center of rotation 361 in the direction of the arrow N is exerted on the joint switch lever 36. Consequently, a force is applied from the pressing part 362 to the projecting part 351 in the direction of the arrow P, or in other words, in the opposite direction of the direction of the force provided by the slide lever spring 28. When the pressing force from the pressing part 362 on the projecting part 351 due to the rotation of the joint switch lever 36 overcomes the biasing force on the slide lever 35 by the slide lever spring 28, the slide lever 35 slides towards the right side of the printing device 1. As a result, the second holding member 25 secured to the slide lever 35 is separated from the first holding member 24 and the third holding member 26, and the communicating state of fluid among the holding members is released. In this way, in the present embodiment, by switching between the communicating state and the non-communicating state of the holding members according to the orientation of the printing device 1, it is possible to suppress the leakage of fluid from the exposed part 241 of the first holding member 24 due to increased hydraulic head pressure.

In this way, in the present embodiment, the joint switch lever 36, the projecting part 351, the slide lever 35, and the slide lever spring 28 function as a switching unit that switches between a communicating state and a non-communicating state of the holding members.

Note that, the present embodiment describes a configuration of the fulcrum of the weight 37 and the joint switch lever 36 illustrated in FIGS. 10A to 10D, which is made to rotate in a direction of rotation in order to make the holding members enter the separated state when the exposed part 241 reaches a lower position in the gravitational direction. However, the fulcrum of the weight and the direction of rotation are not limited to the illustration in the drawings, and may be modified appropriately for individual shapes of a fluid reservoir tank according to the direction of greatest hydraulic head pressure and the position of an opening.

Third Embodiment

In the present embodiment, the configuration of the mechanism for switching between the communicating state and the non-communicating state of the holding members differs from the second embodiment. Other aspects of the configuration are similar to the second embodiment, and thus their description will be reduced or omitted.

Figure 11:
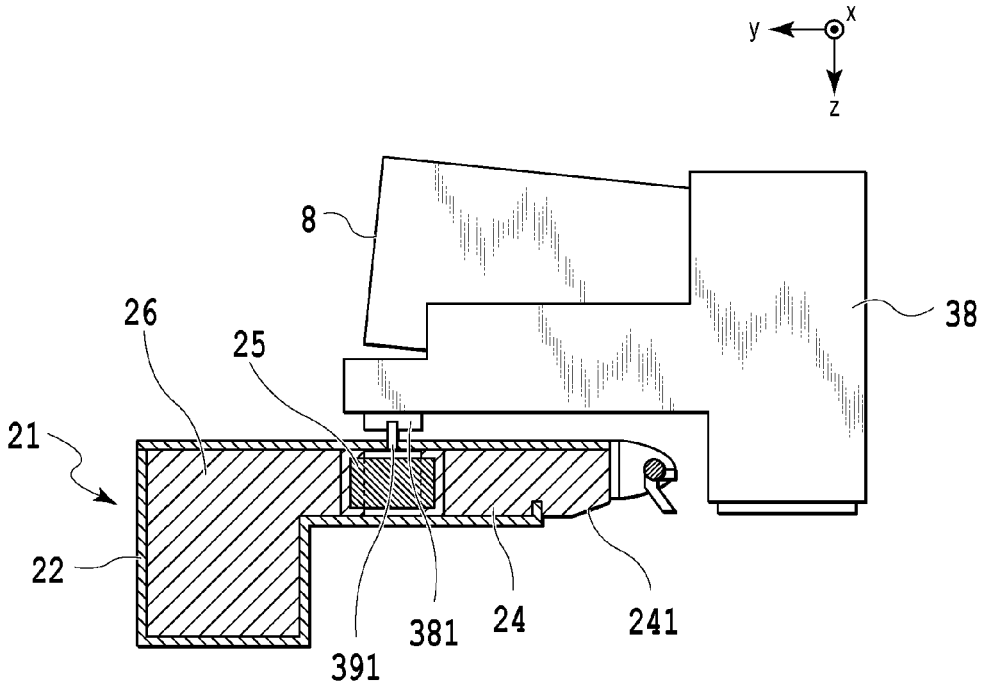
FIG. 11 is a cross-section view illustrating a fluid reservoir tank and a carriage according to a third embodiment.

FIG. 11 is a cross-section view illustrating a fluid reservoir tank 21 and a carriage 38 according to the present embodiment. As illustrated in FIG. 11, a rib (moving part) 381 projecting downwards in the z direction is provided on the bottom face of the carriage 38, which is the lower face in the z direction. In addition, a projecting part 391 projecting upwards in the z direction is provided on the top face of the fluid reservoir tank 21, which is the upper face in the z direction. When the carriage 38 is positioned at the home position, the rib 381 of the carriage 38 is configured to press against the projecting part 391 from the left side to the right side of the printing device 1.

Figure 12:
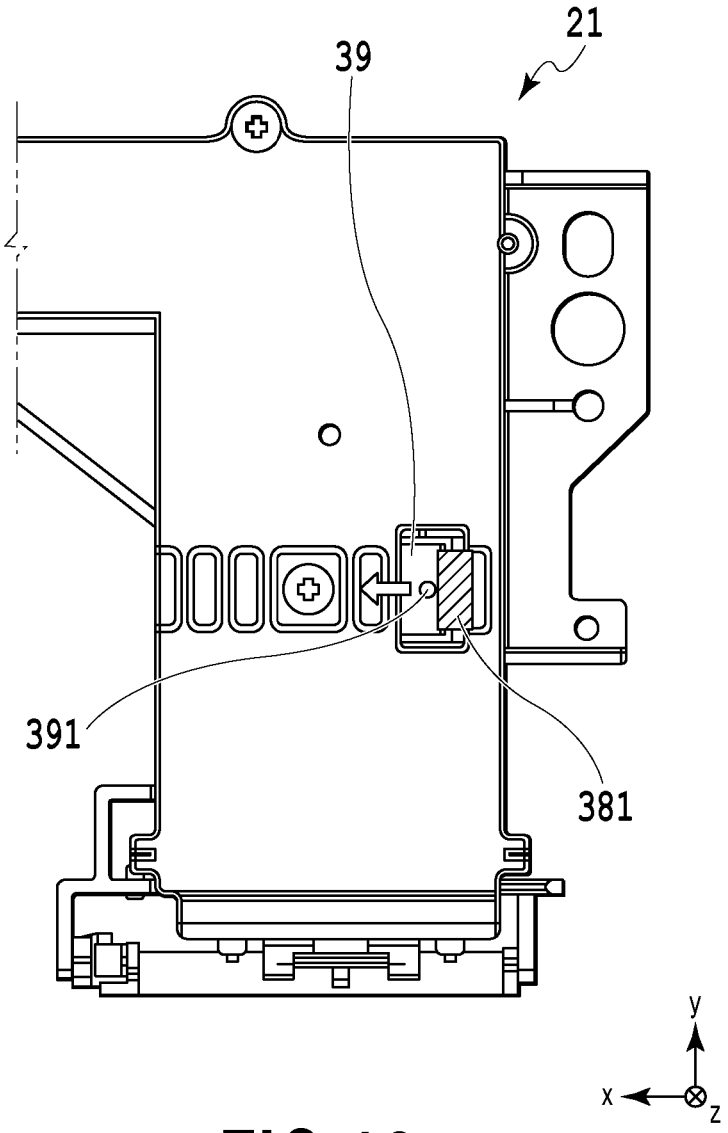
FIG. 12 is atop view illustrating a fluid reservoir tank according to a third embodiment.

FIG. 12 is a top view illustrating the fluid reservoir tank 21 according to the present embodiment. FIG. 12 illustrates the state in which the carriage 38 is positioned at the home position. In FIG. 12, the main body of the carriage 38 is omitted from illustration, and only the rib 381 is illustrated.

As illustrated in FIG. 12, the projecting part 391 is provided on a slide lever 39. Similarly to the embodiment discussed earlier, the second holding member 25 is secured to the slide lever 39. Also, the slide lever 39 is biased from the right side towards the left side of the printing device 1 by a slide lever spring not illustrated in the drawings. In this state, the holding members are in an abutting state, and the fluid held in the holding members is in a communicating state among the holding members.

When the carriage 38 moves from the left side to the right side of the printing device 1 towards the home position, the rib 381 presses the projecting part 391 from the left side to the right side (in the direction of the arrow illustrated in the drawing). When the pressing force on the projecting part 391 by the rib 381 overcomes the biasing force on the slide lever by the slide lever spring not illustrated, the slide lever 39 slides to the right side. As a result, the second holding member 25 secured to the slide lever 39 separates from the first holding member 24 and the third holding member 26, and the communicating state among the holding members of the fluid held in each holding member is released.

In this way, in the present embodiment, the rib 381, the projecting part 391, the slide lever 39, and the slide lever spring not illustrated function as a mechanism for switching between a communicating state and a non-communicating state of the holding members. In the state in which the carriage 38 is positioned at the home position, the holding members are maintained in the non-communicating state.

The carriage 38 is typically controlled to be positioned at the home position when the printing device 1 is powered off. In addition, in the case of changing the location of use of the printing device 1 or the like, the user may also carry the powered-off printing device 1, and at such times it is anticipated that the printing device 1 may be carried in a different orientation than the orientation when the printing device 1 is used. By taking a configuration that switches the communicating state of the holding members to the non-communicating state when the carriage 38 is positioned at the home position, it is possible to prevent fluid leakage from the fluid reservoir tank 21 in cases such as when the orientation of the printing device while powered off becomes different from the orientation during usage.

Note that although the present embodiment describes a configuration that uses the operation of the carriage 38 moving to the home position to switch the state of the holding members from the communicating state to the non-communicating state, the operation of another member that operates when the printing device 1 is powered off may also be used. In addition, the communicating state and the non-communicating state of the holding members may also be switched using the operation of a member driven by a motor, a member that operates by a solenoid, or the like.

Other Embodiments

Although the foregoing embodiments describe a configuration of impregnating the first holding member 24 with fluid to make the first holding member 24 hold fluid, the first holding member 24 may also not be impregnated with fluid in advance. In other words, the first holding member 24 may not necessarily be impregnated with fluid in advance, insofar as the first holding member 24 is still able to fulfill the function of acting as a transfer member that transfers fluid held in another holding member to the wiper blade 17. Additionally, the second holding member 25 may also not be impregnated with fluid, and it is sufficient to impregnate at least the third holding member 26 with fluid. Also, the size and shape of each holding member are not limited to the illustrations in the drawings, and may be modified as appropriate.

Although the foregoing embodiments describe a case of using three holding members, the number of holding members to use is not limited thereto. For example, in the case of using the first holding member 24 and the third holding member 26 while excluding the second holding member 25, the communicating state may be treated as the direct abutment of the first holding member 24 and the third holding member 26 due to the movement of at least one of either holding member, and the non-communicating state may be treated as the release of the communicating state.

In addition, the foregoing embodiments describe a configuration that switches between the communicating state and the non-communicating state of the fluid held in each holding member by causing the second holding member 25 to move. However, the present invention is not limited to this configuration, insofar as the communicating state and the non-communicating state of the fluid among the holding members may be switched. For example, instead of the second holding member 25, a member such as a valve or the like that is able to shut off the communication of fluid between the first holding member 24 and the third holding member 26 may also be used to switch between the communicating state and the non-communicating state of the fluid.

Although the foregoing embodiments describe a configuration that switches between an abutting state that causes the holding members to abut and a separated state that causes the holding members to separate, the holding members may also not be separated. For example, the abutment surface area over which the holding members abut each other may be made narrower during transport than during usage, thereby making the quantity of fluid that communicates among the holding members during transport lower than the quantity of fluid that communicates among the holding members during usage, and decreasing the quantity of fluid at risk of leaking.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-169765, filed Aug. 22, 2014, which is hereby incorporated by reference herein in its entirety.

What is claimed is:

1. A printing device comprising:

a print head having an ejection opening surface on which a plurality of ejection openings that eject ink are formed;

a wiper that performs a wiping operation to wipe the ejection opening surface;

a holding member that holds a fluid to be transferred to the wiper before the wiping operation is performed;

a transfer member that transfers the fluid to the wiper;

a connecting member connectable to the holding member and the transfer member; and a switching unit configured to switch between a communicating state in which the holding member and the transfer member are in fluid communication with each other by moving the connecting member to a connecting position where the connecting member is connected to the holding member and the transfer member, and a non-communicating state in which the holding member and the transfer member are not in fluid communication with each other by moving the connecting member from the connecting position.

2. The printing device according to claim 1, wherein the switching unit includes a biasing member configured to bias the connecting member with respect to the holding member and the transfer member by applying a biasing force, such that the holding member and the transfer member are in the communicating state via the connecting member when the connecting member is biased by the biasing member with respect to the holding member and the transfer member, and the holding member and the transfer member are in the non-communicating state upon release of the communicating state due to a force opposing the biasing force.

3. The printing device according to claim 2, wherein the switching unit includes a moving member to which the connecting member is secured, and which is configured to be movable by being biased by the biasing member, to put the holding member and the transfer member in the communicating state with movement of the moving member caused by the biasing force of the biasing member, and to put the holding member and the transfer member in the non-communicating state with movement of the moving member caused by the force opposing the biasing force from the biasing member.

4. The printing device according to claim 3, further comprising:

a carriage that moves and on which the print head is mounted, wherein the switching unit includes a removable securing member which is removably attached to a device housing of the printing device, and which secures a position of the carriage while in a state of being attached to the device housing, and in the state of the removable securing member being attached to the device housing, puts the holding member and the transfer member in the non-communicating state with movement of the moving member caused by the removable securing member pressing against the moving member due to the force opposing the biasing force.

5. The printing device according to claim 3, wherein the switching unit includes a lever member, and the lever member includes:

a weight part that causes the lever member to rotate when a position of the transfer member becomes lower than a position of the holding member in a gravitational direction, and a pressing part that presses against the moving part due to the force opposing the biasing force as the lever member rotates when the position of the transfer member becomes lower than the position of the holding member in the gravitational direction.

6. The printing device according to claim 3, further comprising:

a carriage that moves and on which the print head is mounted, wherein the switching unit includes a moving part provided on the carriage and configured to move the moving member, and as the carriage moves towards a home position, the moving part causes the moving member to move by applying the force opposing the biasing force.

7. The printing device according to claim 1, wherein during transport, the switching unit puts the holding member and the transfer member in the non-communicating state.

8. The printing device according to claim 1, wherein the transfer member, the connecting member, and the holding member are made from a porous material, and a capillary force of the transfer member is greater than a capillary force of the connecting member, and the capillary force of the connecting member is greater than a capillary force of the holding member.

* * * * *